US006523205B1

(12) United States Patent
Broker et al.

(10) Patent No.: US 6,523,205 B1
(45) Date of Patent: Feb. 25, 2003

(54) SUDS DETECTION AND DISPLAY SYSTEM FOR AN AUTOMATIC WASHING MACHINE

(75) Inventors: John F. Broker, Colfax, IA (US); Douglas A. Ochsner, Newton, IA (US); Evan R. Vande Haar, Pella, IA (US)

(73) Assignee: Maytag Corporation, Newton, IA (US)

( * ) Notice: Subject to any disclaimer, the term of this patent is extended or adjusted under 35 U.S.C. 154(b) by 54 days.

(21) Appl. No.: 09/919,792

(22) Filed: Aug. 2, 2001

(51) Int. Cl.[7] ..... D06F 33/02
(52) U.S. Cl. ..... 8/158; 68/12.02; 68/12.27
(58) Field of Search ..... 8/158; 68/12.01, 68/12.02, 12.05, 12.19, 12.21, 12.27

(56) References Cited

U.S. PATENT DOCUMENTS 4,410,329 A 10/1983 Blevins et al.
5,124,908 A 6/1992 Broadbent
5,859,640 A 1/1999 De Judicibus
5,890,247 A 4/1999 Erickson et al.
5,996,518 A 12/1999 Tomita
6,269,506 B1 * 8/2001 Hollatz et al. ..... 68/12.02 X
6,269,666 B1 * 8/2001 Whah et al. ..... 68/12.02

* cited by examiner

*Primary Examiner*—Philip Coe
(74) *Attorney, Agent, or Firm*—Diederiks & Whitelaw, PLC

(57) ABSTRACT

A clothes washing machine is automatically responsive to indications of high suds level conditions during washing operations to, not only counteract the high level of suds, but effectively educate the user on avoiding the reoccurrence of the conditions. A display, such as an LCD touch screen which is also preferably used to input desired cycle parameters, is integrated into the washing machine for both alerting the user to the occurrence of a high suds level condition and conveying information on how to avoid the development of the situation in the future. In order to avoid prematurely alarming the user, it is preferable to instruct the user only after a predetermined number of high level suds cycles are detected.

20 Claims, 3 Drawing Sheets

SUDS DETECTION AND DISPLAY SYSTEM FOR AN AUTOMATIC WASHING MACHINE

BACKGROUND OF THE INVENTION

1. Field of the Invention

The present invention pertains to the art of washing machines and, more particularly, to a washing machine incorporating a system for detecting and displaying when high suds level conditions develop while laundering articles of clothing in the washing machine.

2. Discussion of the Prior Art

The development of suds during operation of an automatic washing machine is a problem that has been recognized in the art. Actually, high levels of suds can form throughout various cycles of a washing operation. In more conventional vertical axis or top-loading washing machines, high levels of suds can be developed during a wash cycle when a water/detergent solution which has a rather high detergent content is placed in turbulence by the operation of an agitator. For front-loading washing machines, the potential of developing high levels of suds can be even greater during wash cycles given the tumbling action of the clothes through the water/detergent solution. In each of these types of known washing machines, high levels of suds can also develop during spin cycles due to the creation of turbulent air when a washing machine basket is rotated at high RPMs. More specifically, during spin cycles the water/detergent solution is directed into a drainage zone by the centrifugal force of the rotating washing machine basket and combines with the turbulent air in the drainage zone to generate suds that can flow back into the basket.

At the end of a wash cycle in either a top or front-loading washing machine, the water/detergent solution is subjected to a drainage operation, followed by a spin period for the washing machine basket. It is desired to remove as much of the water/detergent from the clothes as possible during these steps. Thereafter, the clothes are subjected to various rinse cycles, during which the clothes are agitated or tumbled within fresh water supplied within the basket. Each rinse cycle may also terminate in sequential draining and spinning operations. The development of high levels of suds can be problematic during both the wash and rinse cycles for various reasons. For instance, whenever the washing machine enters a spin mode, the presence of high levels of suds can produce a heavy and possibly excessive load on the motor used to drive the washing machine basket. In addition, the development of high levels of suds may result in a residual water/detergent solution remaining in the laundered clothes, even if several rinse cycles are incorporated in the overall washing operation.

The prior art has addressed this known problem in various fashions. In general, each of the proposed solutions focuses on the reduction of suds during a particular cycle or mode of operation of the washing machine. For example, U.S. Pat. No. 4,410,329 is directed to correcting an over-suds condition that develops during a wash cycle. More specifically, when the over-suds condition is sensed, the wash cycle operation is suspended to enable the clothing and suds in the basket to be sprayed with cold water for a preset period of time and then the clothes are allowed to cool while the bubbles collapse before the washing operation is resumed. Another solution is proposed in U.S. Pat. No. 5,596,889 which is solely directed toward the elimination of high levels of suds produced during spin cycles. In accordance with this patented arrangement, each spinning operation is carried out in multiple stages, with the washing machine basket being rotated at varying speeds during the individual stages. Finally, U.S. Pat. No. 5,890,247 discloses a suds detection and control system which functions to alter the mechanical actions imparted upon articles of clothing during wash and rinse cycles and/or add a supplemental rinse cycle to an overall washing operation in response to an indication of a high suds level condition in the machine.

To date, known prior art suds control systems only address the problem by directly, automatically counteracting a suds condition following detection thereof. Therefore, the user of the washing machine is not actually provided with any indication that an over-suds condition even developed. Since the over-suds condition can be directly attributed to the manner in which the washing machine is operated by the user, the prior art really fails to address the source of the problem. Based on the above, there exists a need in the art for a system designed to notify the user when over-suds conditions are detected in at least a certain number of cycles, as well as to educate the user of the machine on how to avoid developing similar conditions in future cycles.

SUMMARY OF THE INVENTION

The present invention is directed to a control system for a clothes washing machine which is automatically responsive to indications of high suds level conditions during washing operations to, not only effectively counteract the high level of suds, but effectively educating the user on avoiding the reoccurrence of the conditions. Most preferably, a display, such as an LCD touch screen which is also preferably used to input desired cycle parameters, is integrated into the washing machine for conveying information to the user on how to avoid the development of future over-suds conditions.

In accordance with the invention, a high suds level condition is preferably indicated by detecting an operating parameter of the washing machine, such as the motor torque, which may be affected when high levels of suds exist. Signals from the detection unit are preferably correlated into torque values for the drive system and current torque values are compared with stored values to determine when a load is placed upon the drive system which is indicative of the presence of high levels of suds. Regardless of the particular type of suds detection system employed, it is preferable to instruct the user only after a predetermined number of high level suds cycles are detected. More specifically, the most preferred embodiment of the invention provides for informing the user when four out of the last seven cycles have been designated as high suds cycles. In addition, further instructions can be presented through the display to guide the user on eliminating the problem. If the user actually notices that the washing tub is full of suds upon termination of a laundering operation, instructions can be directly accessed through the display by the user. The invention is applicable to various types of washing machines, including vertical axis machines and, particularly, front-loading machines.

Additional objects, features and advantages of the present invention will become more readily apparent from the following detailed description of a preferred embodiment when taken in conjunction with the drawings wherein like reference numerals refer to corresponding parts in the several views.

DETAILED DESCRIPTION OF THE PREFERRED EMBODIMENT

Figure 1:
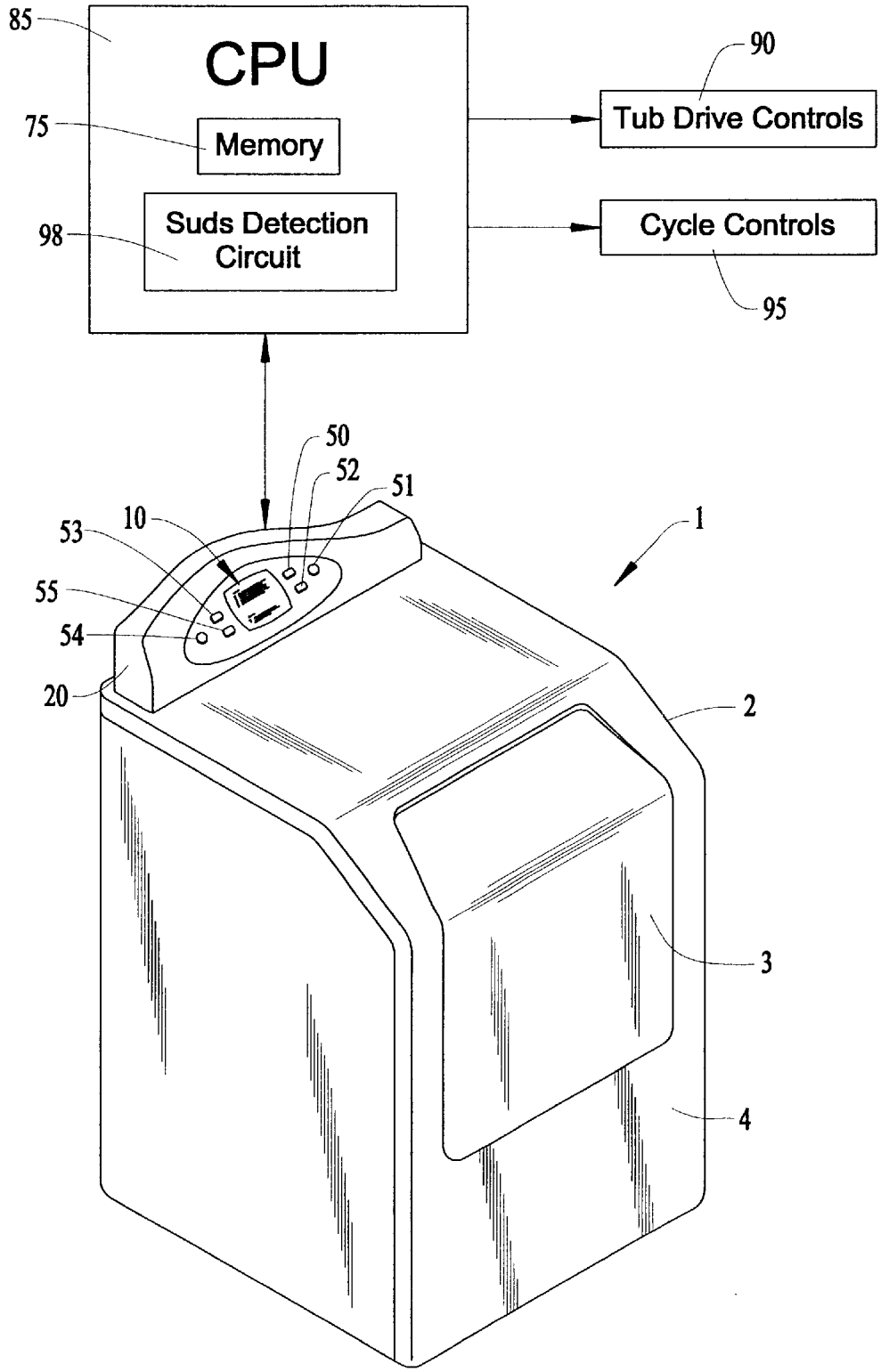
FIG. 1 is a perspective view of a washing machine incorporating the suds detection and display system of the present invention.

With initial reference to FIG. 1, a laundry appliance 1 is schematically shown in the form of a washing machine. Appliance 1 includes a cabinet 2 provided with a door 3 in a front face 4. Door 3 is designed to be pivoted to expose an integral washing tub (not shown). A display 10 is integrated into a control panel 20 through which a user can control and program washing appliance 1 as will be detailed below. Appliance 1 also includes various control buttons 50–56 shown about display 10.

In accordance with a preferred embodiment of the invention, an "OFF" button 50 is provided to selectively turn off or reset laundry appliance 1. Button 51 constitutes a "START/PAUSE" button used to initiate or pause a selected washing operation. A "HELP" button 52 is provided to enter a help control mode as will be discussed further below. A "HOME" button 53 is used to enter another control mode which will also be discussed fully below. Button 54 enables direct access to "FAVORITES" relating to preferred cycle parameters stored by a user in a memory 75 of a CPU 85 used to regulate tub drive controls, generally indicated at 90, and cycle controls 95. Finally, a "BACK" button 55 is provided to erase an inadvertently inputted control parameter or revert back to a prior screen on display 10. As will also become more fully evident below, the particular control configuration for laundry appliance 1 can significantly vary in accordance with the present invention.

In accordance with the present invention, CPU 85 includes a suds detection circuit 98 adapted to receive signals representing at least one operating parameter of automatic washing machine 1 which is responsive to high suds level conditions that can develop during laundering operations. The actual manner in which the high suds level conditions are detected can take various forms known in the art for purposes of the present invention. In general, the detection arrangement is based on reading torque values which are compared with reference torque values to provide an indication of a high suds level condition. A preferred embodiment is based on torque indications for a motor (not shown) used to drive the washing tub provided within cabinet 2. Actually, a preferred detection system is disclosed in U.S. Pat. No. 5,890,247 which is co-owned with the present invention and incorporated herein by reference.

In accordance with the present invention, it is desired to verify the high suds level condition and, following verification, provide an indication of the condition to the user through display 10. Therefore, although the user could be informed whenever a high suds condition is sensed during a given laundering operation, it is preferable to first verify that a pattern of high suds level conditions exist before alerting the user. To this end, a preferred embodiment functions by storing detected high suds level conditions in memory 75. When a predetermined number of high suds level conditions are detected during a preset number of laundering operations, then the user will be alerted to the situation. Most preferably, verification of the development of high suds level conditions which is considered to warrant the alerting of the user is when a high suds level condition is detected in four out of the last seven cycles.

Figure 2:
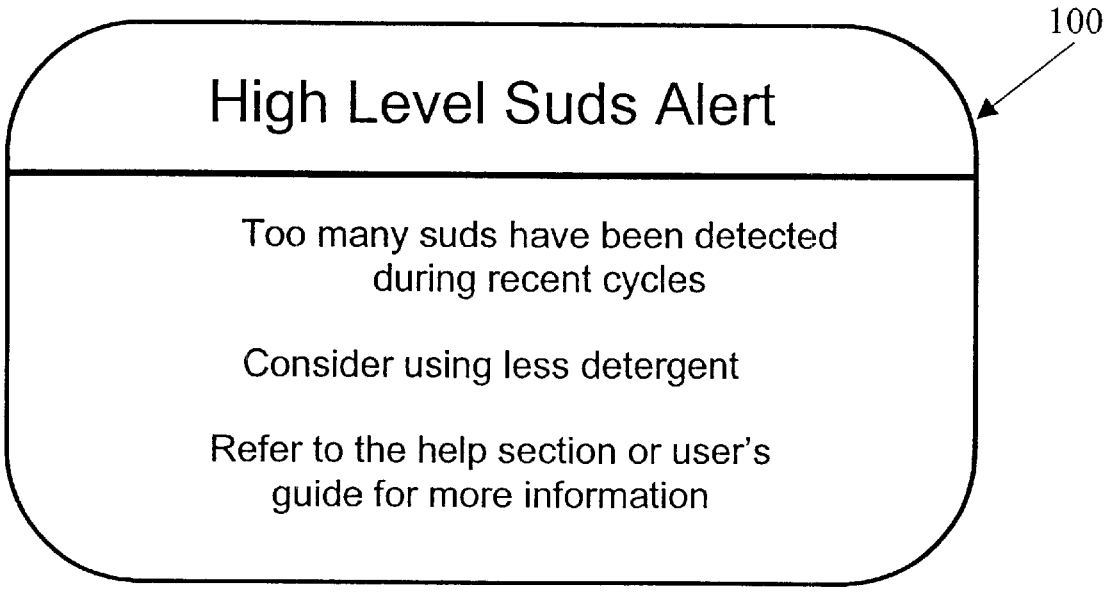
FIG. 2 illustrates an instructional screen presented to the user in accordance with the invention.

Once a high suds level condition is verified as discussed above, it is actually preferable to present information in text form to the user through display 10. More specifically, as shown in FIG. 2, it is desired to notify the user that "Too many suds have been detected during recent cycles" in a pop-up window or screen 100 presented in display 10. In addition, it is further desired to instruct the user on preventing future occurrences of high suds level conditions. For instance, the user can be instructed to "Consider using less detergent". Furthermore, to also aid the user in preventing future occurrences, other instructions, concerning where more information can be obtained to address this issue, can be presented. These other instructions can include referring the user to a guide supplied with washing machine 1 or accessing information available through a help menu also available through display 10 as will now be discussed with particular reference to FIG. 3.

Figure 3:
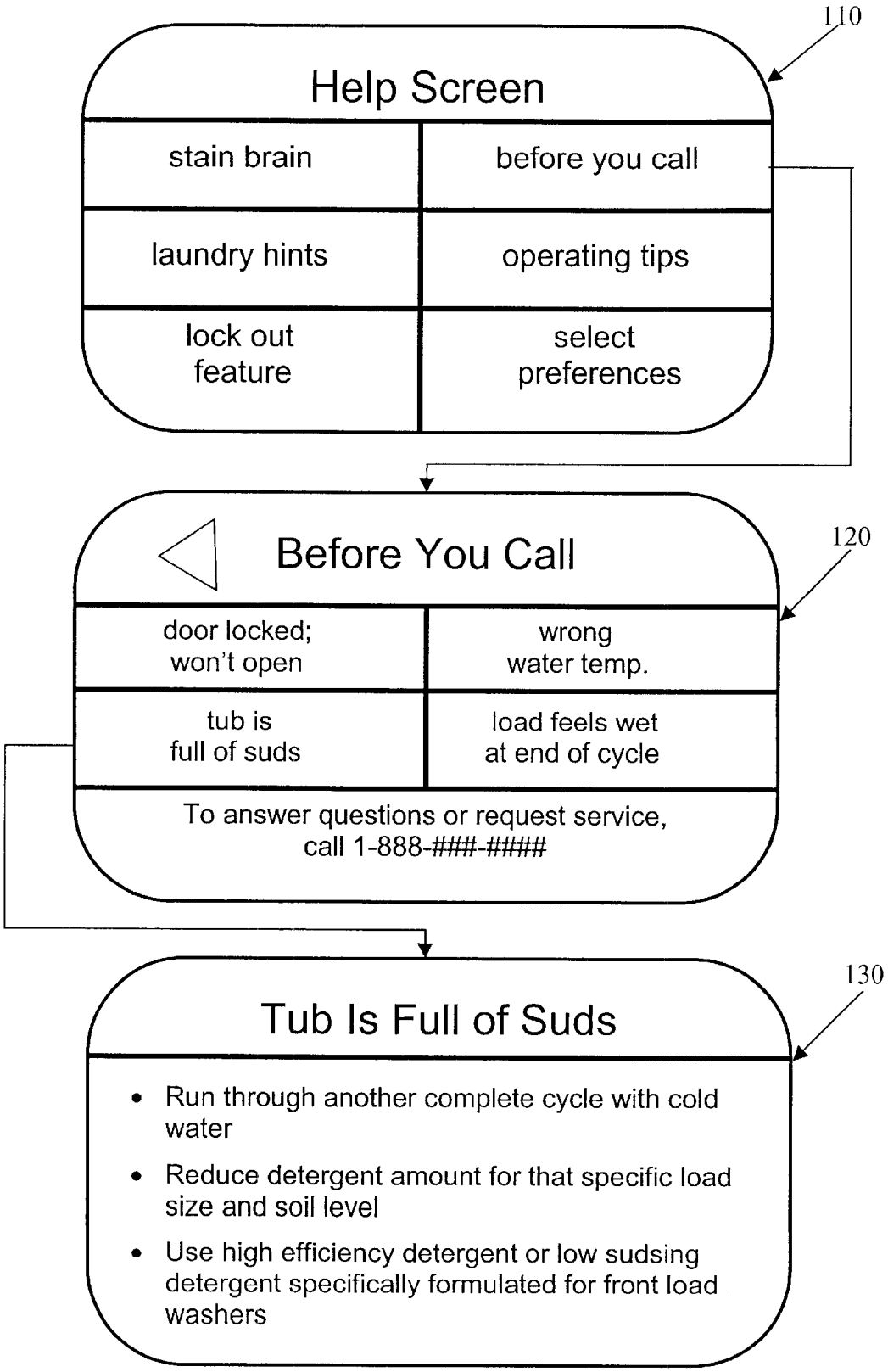
FIG. 3 is a diagrammatic representation of an operating screen sequence employed in accordance with a preferred embodiment of the invention.

By pressing "HELP" button 52, the user will be presented with screen 110 as shown in FIG. 3. For purposes of the present invention, although various help selections are available, it is assumed that the user has chosen the "Before you call" option by simply touching this section of screen 110. Through this selection, the user can reach screen 120. Again, for purposes of the present invention, it is assume that the user selects "tub is full of suds". Thereafter, the user will be presented with instructional information such as that shown in screen 130 of FIG. 3. In accordance with the most preferred form of the invention, the user will be instructed to run through another complete cycle in washing machine 1 utilizing cold water, to reduce the amount of detergent being employed for selected load, size and soil levels and/or to utilize a high efficiency or low sudsing detergent, preferably one specially formulated for the type of washing machine.

Based on the above discussion, it should be readily apparent that incorporating display 10 into washing machine 1 enables an abundance of information to be conveyed to the user. In accordance with the present invention, this information relates to both alerting the user of the existence of a high suds level condition and providing instructional assistance to counteract the development of high suds levels in the future. If the user actually observes a high level of suds in the washing tub, the help sequence described above with reference to FIG. 3 and accessible through "HELP" button 52 can be used to address the problem. Therefore, the user can be advantageously educated on the creation of too many suds in a variety of ways in accordance with the present invention. In addition, the invention employs a verification system so as to avoid falsely alarming the user on the existence of any high suds level conditions.

Although described with reference to a preferred embodiment of the invention, it should be readily understood that various changes and/or modifications can be made to the invention without departing from the spirit thereof. In general, the invention is only intended to be limited by the scope of the following claims.

We claim:

1. An automatic washing machine for performing laundering operations including wash and rinse cycles during which mechanical actions are imparted upon articles of clothing comprising:

a cabinet including a control panel;

a display integrated into the control panel, said display being adapted to present a plurality of visual screens to a user of the washing machine; and a control system adapted to detect high suds level conditions developed within the washing machine during the laundering operations and for signaling the display to present information to the user concerning a high suds level condition.

2. The automatic washing machine according to claim 1, wherein the display is constituted by a touch screen display.

3. The automatic washing machine according to claim 1, wherein the control system includes means for storing information concerning the high suds level conditions.

4. The automatic washing machine according to claim 3, wherein the control system causes the display to present the information concerning the high suds level condition only after verification of the high suds level condition.

5. The automatic washing machine according to claim 4, wherein the control system verifies the high suds level condition when a predetermined number of high suds level conditions are detected during a preset number of laundering operations.

6. The automatic washing machine according to claim 1, wherein the information concerning the high suds level condition includes instructions on preventing future occurrences of high suds level conditions.

7. An automatic washing machine for performing laundering operations including wash and rinse cycles during which mechanical actions are imparted upon articles of clothing comprising:

a cabinet including a control panel;

display means, integrated into the control panel, for presenting a plurality of visual screens to a user of the washing machine; and control means for detecting high suds level conditions developed within the washing machine during the laundering operations and signaling the display to present information to the user concerning a high suds level condition.

8. The automatic washing machine according to claim 7, wherein the display means constitutes a touch screen display.

9. The automatic washing machine according to claim 7, wherein the control means includes means for storing information concerning the high suds level conditions.

10. The automatic washing machine according to claim 9, wherein the control means causes the display means to present the information concerning the high suds level condition only after verification of the high suds level condition.

11. The automatic washing machine according to claim 10, wherein the control means verifies the high suds level condition when a predetermined number of high suds level conditions are detected during a preset number of laundering operations.

12. The automatic washing machine according to claim 11, wherein the control means signals the display means to present the information concerning the high suds level condition when four out of the last seven cycles indicate high suds level conditions.

13. The automatic washing machine according to claim 7, wherein the information concerning the high suds level condition includes instructions on preventing future occurrences of high suds level conditions.

14. A method of operating a clothes washing machine comprising:

sensing a high suds level condition developed during a laundering operation in the washing machine; and providing information to a user of the washing machine concerning the high suds level condition through a visual display incorporated into the washing machine.

15. The method of claim 14, wherein the display provides text information to the user.

16. The method of claim 15, further comprising: programming the washing machine for a laundering operation through the display.

17. The method of claim 16, further comprising: providing a screen sequence on the display to instruct the user on preventing future occurrences of high suds level conditions.

18. The method of claim 14, further comprising:

verifying the high suds level condition; and presenting the information only after verification of the high suds level condition.

19. The method of claim 18, further comprising: verifying the high suds level condition when a predetermined number of high suds level conditions are detected during a preset number of laundering operations.

20. The method of claim 19, further comprising: verifying the high suds level condition by detecting when four out of the last seven cycles indicate high suds level conditions.

* * * * *